United States Patent [19]

Stutz et al.

[11] Patent Number: 4,816,550

[45] Date of Patent: Mar. 28, 1989

[54] POLYAMIDE FEED YARN FOR AIR-JET TEXTURING

[75] Inventors: Frank Stutz; Jing-peir Yu; Stanley E. McKinney, all of Pensacola, Fla.

[73] Assignee: Monsanto Company, St. Louis, Mo.

[21] Appl. No.: 143,212

[22] Filed: Jan. 11, 1988

Related U.S. Application Data

[63] Continuation of Ser. No. 776,932, Sep. 17, 1985, abandoned.

[51] Int. Cl.[4] ..... C08G 69/46

[52] U.S. Cl. ..... 528/335; 264/167; 264/178 F

[58] Field of Search ..... 528/335

[56] References Cited

U.S. PATENT DOCUMENTS

| | | | |
|---|---|---|---|
| 2,939,201 | 6/1960 | Holland | 28/82 |
| 3,308,221 | 3/1967 | Opfell | 264/174 |
| 3,548,584 | 12/1970 | Silverman et al. | 57/140 |
| 3,858,387 | 1/1975 | Baliga et al. | 57/140 |
| 3,994,121 | 11/1976 | Adams | 57/140 |
| 4,093,147 | 6/1978 | Bromley et al. | 242/159 |
| 4,123,492 | 10/1978 | McNamara | 264/210 F |
| 4,181,697 | 1/1980 | Koschinek et al. | 264/176 |
| 4,446,299 | 5/1984 | Koschinek et al. | 528/272 |
| 4,492,731 | 1/1985 | Bankar et al. | 428/362 |
| 4,542,063 | 9/1985 | Tanji et al. | 428/364 |
| 4,583,357 | 4/1986 | Chamberlin et al. | 57/243 |

OTHER PUBLICATIONS

Annual Book of ASTM Standards 1982, Part 36, pp. 57–65.

*Primary Examiner*—Harold D. Anderson
*Attorney, Agent, or Firm*—John W. Whisler

[57] ABSTRACT

Improved feed yarns for air-jet texturing are provided by using high molecular weight polyamide polymer spun through non-round capillaries at high spinning speeds to give filament modification ratios greater than 1.5.

9 Claims, 1 Drawing Sheet

POLYAMIDE FEED YARN FOR AIR-JET TEXTURING

Figure 1:
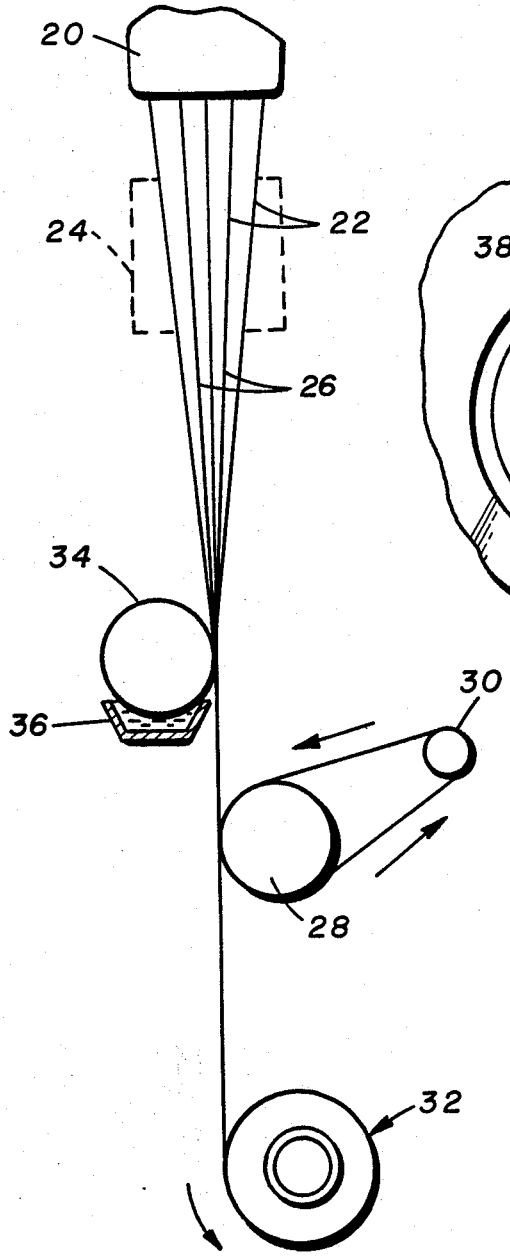

This is a continuation of application Ser. No. 776,932, filed Sep. 17, 1986, now abandoned.

The invention relates to the art of air-jet texturing, and more particularly to air-jet texturing using improved feed yarns providing higher texturing speeds, deeper dyeing, and a softer hand and improved covering power in the resulting textured yarns.

Air-jet texturing has long been known in the art, dating back at least as early as U.S. Pat. No. 2,783,609 to Breen, which disclosed very slow processing speeds and high air consumption. The disclosure of the Breen patent is incorporated herein by reference. Numerous jet designs have been suggested in an effort to increase processing speeds and reduce air consumption, as well as to improve the properties of the resulting textured yarn. Substantial improvements have been made in jet design along these lines. However, little is known to have been done to improve the feed yarns themselves.

It has been discovered that substantial further improvements in the matters of increased texturing speeds, reduced air consumption, deeper dyeing, softer hand, and increased covering power can be achieved by use of certain novel feed yarns for air-jet texturing as hereinafter disclosed.

According to a first principal aspect of the invention there is provided a novel polyamide feed yarn for air-jet texturing, the yarn comprising filaments having modification ratios between 1.5 and 4.0; a normalized SAXS peak intensity of at least 1.3; and a normalized lamellar dimensional product of at least 1.3.

According to a second principal aspect of the invention, there is provided a process for melt spinning a feed yarn for air-jet texturing, the process comprising metering at a given rate a plurality of molten polyamide streams through non-round spinneret capillaries into a quench zone; quenching the streams to form a plurality of filaments; converging the filaments to form a yarn; withdrawing the yarn at a spinning speed of at least 2200 MPM; the polymer, the metering rate, the capillaries, and the spinning speed being selected such that the filaments have modification ratios between 1.5 and 4.0; a normalized SAXS peak intensity of at least 1.3; and a normalized lamellar dimensional product of at least 1.3.

According to a third principal aspect of the invention, there is provided a feed yarn for air-jet texturing, the yarn having an elongation less than 100%, the yarn comprising filaments having a normalized SAXS peak intensity of at least 1.3; a normalized lamellar dimensional product of at least 1.3, less than 3 branches, and modification ratios greater than 1.5.

According to a fourth major aspect of the invention, there is provided a process for melt spinning a feed yarn for air-jet texturing, the process comprising metering at a given rate a plurality of molten streams through non-round spinneret capillaries into a quench zone; quenching the streams to form a plurality of filaments; converging the filaments to form a yarn; withdrawing the yarn at a spinning speed of at least 2200 MPM; the polymer, the metering rate, the capillaries, and the spinning speed being selected such that the filaments have modification ratios greater than 1.5; less than 3 branches; a normalized SAXS peak intensity of at least 1.3; and a normalized lamellar dimensional product of at least 1.3.

According to a fifth major aspect of the invention, there is provided in a process for producing a textured yarn wherein a core yarn and an effect yarn are overfed to and plied in a turbulent gaseous zone,the improvement wherein the effect yarn comprises filaments having modification ratios greater than 1.5; a normalized SAXS peak intensity of at least 1.3; and a normalised lamellar dimensional product of at least 1.3.

In accordance with each of the above major aspects, the filaments are preferably polyamide having a formic acid RV of at least 46, with improved results obtained when the filaments have an RV of at least 53. Best results are achieved when the filaments have an RV of. at least 65. Preferably the filaments are nylon 66. Advantageously the need yarn has an elongation less than 100%. It is preferred that the filaments have modification ratios between 1.5 and 4.0.

Figure 2:
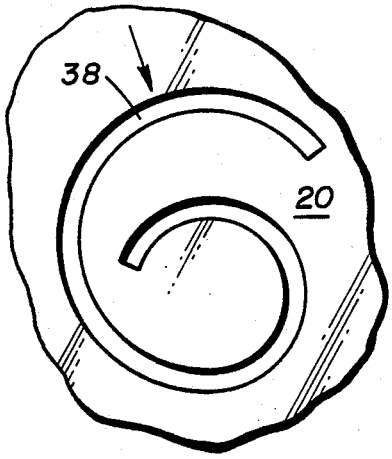

Other aspects will appear hereinafter in the following detailed description of the invention taken in connection with the accompanying drawing, wherein:

FIG. 1 is a schematic elevation view of exemplary melt spinning apparatus for making the feed yarns of the invention; and FIG. 2 is a bottom plan view of an examplary spinneret capillary for use with the FIG. 1 apparatus.

EXAMPLE I

This is an example of air-jet texturing according to conventional practice. A conventional air-jet texturing apparatus is used employing a commercially available Hemajet Type 311 texturing jet, with water being applied to the yarns prior to entry to the jet. A nylon 66 core yarn having 300 denier and 136 filaments is fed from a first feed roll to the jet yarn inlet, the filaments of the core yarn having round cross-sections. The first feed roll runs 14% faster than the delivery roll which withdraws the textured yarn from the jet, thus providing a 14% overfeed of the core yarn to the jet. An effect yarn having 170 denier and 34 round cross-section filaments is fed from a second feed roll to the jet yarn inlet, the speed of the second feed roll being 84.6% higher than that of the delivery roll, thus providing an 84.6% overfeed of the effect yarn to the jet.

The textured yarn, which consists of the core yarn intermingled with the effect yarn, is withdrawn from the jet exit at right angles to the jet axis by the delivery roll. Air pressure to the texturing jet is set at 130 psig. The speed of the delivery roll is set at the maximum at which the process operates satisfactorily, which is about 91 MPM.

EXAMPLE II

Various nylon 66 effect yarns are prepared using 40 RV polymer. The yarns are sbun at 1400 MPM, conventionally quenched steamed and wound, then drawn on a drawtwister to provide drawn 70 denier 34 filament effect yarns having elongations of about 30–40%. The spinneret capillaries are selected, as suggested in U.S. Pat. No. 3,097,412 to Bacher, to provide cruciform, Y-shaped, delta-shaped, ribbon, and dumbbell and other such filamentary cross sections.

Example I is repeated using the various effect yarns instead of the round cross section effect yarn of Example I. The resulting textured yarns have increased bulk as compared to Example I.

EXAMPLE III

This is an example of preparation of an improved effect yarn according to the invention. Nylon 66 polymer is dried and melt spun at a temperature of 295° C. using the FIG. 1 apparatus and the FIG. 2 spinneret capillary design to provide a yarn RV of 65. As shown in FIG. 1, the polymer is extruded through non-round orifices in spinneret 20 as a plurality of molten streams 22 into quench chamber 24 supplied with quenching air moving transversely with respect to the streams. The filaments 26 resulting from quenching the molten streams are withdrawn at a predetermined spinning speed determined by roll 28 and its associated separator roll 30. Filaments 26 are converged into a yarn bundle, as at finish roll 34 slowly rotating in finish pan 36, the yarn being conventionally wound by winder 32. The speed of winder 32 is selected to provide a winding tension of about 0.1 grams per denier.

The 34 spinneret capillaries are of the type illustrated in FIG. 2, with capillary slot 38 being 0.1 MM wide and 4 MM long along its spiral length. The quenching air has a temperature of 18° C. and a horizontal velocity of 20 MPM, and is supplied in the direction indicated by the arrow in FIG. 2. Quench chamber 24 is 1.5 meters high. The spinning speed (the speed of roll 28) is 3500 MPM, and the polymer metering rate is selected to provide a yarn denier of 170. The resulting yarn has an elongation of about 75%, and the filaments have cross-sections in the form of the numeral "6" and modification ratios of 4.0. The yarn has a normalized SAXS peak intensity of 3 and a normalized lamellar dimensional product of more than 1.5.

EXAMPLE IV

Example I is repeated except that the conventional round cross-section effect yarn is replaced by the effect yarn of Example III. The improved effect yarn of the invention provides for increased tension at the inlet to the air jet for a given delivery speed, permitting substantially increased processing speeds and hence substantially increased productivity in the air-jet texturing process. With the specific effect yarn of this example, the texturing speed of Example I may be approximately doubled to 183 MPM.

Further, the textured yarns of this example have a softer, more luxurious hand and increased dyeability as compared to those of Examples I and II. This is attributable to the unique internal structure of the filaments provided by high RV yarn spun at above 2200 MPM spinning speed.

There is evidence indicating that the covering power of the textured yarn is not greatly affected by latent self-crimp in the effect yarns of the invention, but rather is largely determined by the modification ratios of the filaments and textured yarn denier, all other things being equal.

There is likewise evidence that increased modification ratios permit increased overfeed of the effect yarn with respect to the core yarn, and that with increased overfeed the crunodal loops in the textured yarn decrease in amplitude and increase in number. This results in an increased spun-like hand in the textured yarn and in fabrics formed therefrom, and the smaller protruding crunodal loops are less likely to snag or cause other problems either in processing or in the subsequent use of the fabric.

TEST METHODS AND DEFINITIONS

"Modification ratio" is used herein in the conventional sense, and is the quotient of the diameter of the smallest circle circumscribing the filament cross section and the diameter of the largest circle which can be inscribed within the filament cross section.

All yarn packages to be tested are conditioned at 21 degrees C. and 65% relative humidity for one day prior to testing.

The yarn elongation-to-break (elongation) is measured one week after spinning. Fifty yards of yarn are stripped from the bobbin and discarded. Elongation-to-break is determined using an Instron tensile testing instrument. The gage length (initial length of yarn sample between clamps on the instrument) is 25 cm., and the crosshead speed is 30 cm. per minute. The yarn is extended until it breaks. Elongation-to-break is defined as the increase in sample length at the time of maximum load or force (stress) applied, expressed as a percentage of the original gage length (25 cm).

Relative viscosity (R.V.) is determined by ASTM D789-81, an appropriate viscometer and a solution of 11.0 grams of the polyamide in 100 ml. of 90% formic acid with the R.V. being the ratio of the absolute viscosity of the polyamide solution to that of the 90% formic acid measured at 25° C.

The reference polymer is nylon-66 formed from stoichiometric amounts of hexamethylene diamine and adipic acid, further containing as the sole additives 44 parts per million manganese hypophosphite monohydrate, 898 parts per million acetic acid as a molecular weight stabilizer and 3000 parts per million titanium dioxide pigment. Polymerization is conventional, to provide a nominal polymer R.V. of 38–40.

The reference yarn is prepared by appropriately adjusting the moisture level in the reference polymer, then spinning under the same spinning conditions as the yarn being tested was made to provide a 40 RV reference yarn having the same denier and denier per filament as the yarn sample being tested.

X-Ray Techniques

The X-ray diffraction patterns (small angle X-ray scattering, or SAXS) are recorded on NS54T Kodak no-screen medical X-ray film using evacuated flat plate Laue cameras (Statton type). Specimen to film distance is 32.0 cm.; incident beam collimator length is 3.0 inches, exposure time is 8 hours. Interchangeable Statton type yarn holders with 0.5 mm. diameter pinholes and 0.5 mm. yarn sheath thickness are used throughout as well as 0.5 mm. entrance pinholes. The filaments of each sheath of yarn are aligned parallel to one another and perpendicular to the X-ray beam. A copper fine focus X-ray ($\lambda = 1.5418$A) is used with a nickel filter at 40 KV and 26.26 MA, 85% of their rated load. For each X-ray exposure a single film is used in the film cassette. This film is evaluated on a scanning P-1000 Obtronics Densitometer for information concerning scattering intensity and discrete scattering distribution characteristics in the equatorial and meridional directions. A curve fitting procedure, using Pearson VII functions [see H. M. Heuvel and R. Huisman, *J.Appl.Poly. Sci.*, 22, 2229–2243 (1978)] together with a second order polynomial background function,.is used to fit the experimental data prior to calculation. A meridional scan is performed, the discrete scattering fitted, equatorial scans are performed through each discrete scattering maxima and then again the data is fitted via a parameter fit procedure.

The peak height intensity is taken as an average of the four fitted intensity distributions (i.e., the two mirrored discrete scattering distributions in the meridional directions and the two equatorial distributions through these meridional maxima). The normalized SAXS peak intensity is then simply the ratio of the measured peak intensity to that of the measured peak intensity of a 40 RV yarn sample of the same denier and denier per filament spun from the reference polymer under the same conditions as the yarn sample.

The SAXS discrete scattering X-ray diffraction maxima are used to determine the average lamellar dimensions. In the meridional direction this is taken here to be the average size of the lamellar scattered in the fiber direction and in the equatorial direction, the average size of the lamellar scattered in a direction perpendicular to the fiber direction. These sizes are estimated from the breadth of the diffraction maxima using Scherrer's method, D(meridional or equatorial)$=K\lambda/\beta \cos \theta$, where K is the shape factor depending on the say $\beta$ is determined, as discussed below, $\lambda$ is the X-ray wave length, in this case 1.5418 A, $\theta$ is the Bragg angle, and $\beta$ the spot width of the discreted scattering in radians.

$$\beta(\text{meridional})=2\theta_D-2\theta_{\beta'}$$

where $2\theta_D$ (radians)$=$Arctan ((HW$+$w)/2r)

$2\theta_\beta$(radians)$=$Arctan ((HW$-$w)/2r)

r$=$the fiber to film distance 320 mm.

w$=$the corrected half width of the scattering as discussed below

HW$=$peak to peak distance (mm.) between discrete scattering maxima

The Scherrer equation is again used to calculate the size of the lamellar scattered in the equatorial direction through the discrete scattering maxima, $$\beta(\text{equatorial})=2 \text{ Arctan } (w/2r^*)$$

where $R^*=((HW/2)^2+(320)^2)^{\frac{1}{2}}$

Warren's correction for line broadening due to instrumental effects is used as a correction for Scherrer's line broadening equation, $$W_m^2=w^2+W^2$$

where $W_m$ is the measured line width, W$=$0.39 mm. is the instrumental contribution obtained from inorganic standards, and w is the corrected line width (either in the equatorial or meridional directions) used to calculate the spot width in radians, $\beta$. The measured line width $W_m$ is taken as the width at which the diffraction intensity on a given film falls to a value of one-half the maximum intensity and is the half width parameter of the curve fitting procedure. Correspondingly, a value of 0.90 is employed for the shape factor K in Scherrer's equations. Any broadening due to variation of periodicity is neglected.

The lamellar dimensional product is given then by $$\text{LDP}=\text{D(meridional)}\times\text{D(equatorial)}$$

and the normalized lamellar dimensional product is then simply the ratio of the lamellar dimensional product to that of a 40 RV yarn sample of the same denier and denier per filament spun from the reference polymer under the same conditions as the yarn sample.

We claim:

1. A feed yarns for air-jet texturing spun at a spinning speed greater than 2200 MPM, said yarn comprising:

a. polyamide filaments having a relative viscosity of at least 46, as measured on a solution of 11.0 grams of polyamide dissolved in 100 ml of 90% formic acid at 25° C. and a modification ratio between 1.5 and 4.0;

b. a normalized small angle x-ray scattering peak intensity of at least 1.3; and c. a normalized lamellar dimensional product of at least 1.3.

2. The yarn defined in claim 1, wherein said polyamide has a relative viscosity of at least 53, as measured on a solution of 11.0 grams of polyamide dissolved in 100 ml of 90% formic acid at 25° C.

3. The yarn defined in claim 1, wherein said polyamide has a relative viscosity of at least 65, as measured on a solution of 11.0 grams of polyamide dissolved in 100 ml of 90% formic acid at 25° C.

4. The yarn defined in claim 1, wherein said polyamide is nylon 66.

5. The yarn defined in claim 1, wherein said yarn has an elongation of less than 100%.

6. A feed yarn for air-jet texturing spun at a spinning speed greater than 2200 MPM, said yarn having an elongation less than 100%, said yarn comprising polyamide filaments having:

a. a normalized small angle x-ray scattering peak intensity of at least 1.3;

b. a normalized lamellar dimensional product of at least 1.3;

c. less than 3 branches; and d. a modification ratio greater than 1.5 and a relative viscosity of at least 46, as measured on a solution of 11.0 grams of polyamide dissolved in 100 ml of 90% formic acid at 25° C.

7. The yarn defined in claim 6, wherein said polyamide having a relative viscosity of at least 53, as measured on a solution of 11.0 grams of polyamide dissolved in 100 ml of 90% formic acid at 25° C.

8. The yarn defined in claim 6, wherein said polyamide having a relative viscosity of at least 65, as measured on a solution of 11.0 grams of polyamide dissolved in 100 ml of 90% formic acid at 25° C.

9. The yarn defined in claim 6, wherein said polyamide is nylon 66.

* * * * *